United States Patent [19]

Ueno

[11] Patent Number: 4,463,717

[45] Date of Patent: Aug. 7, 1984

[54] VALVE STOPPING DEVICE OF INTERNAL COMBUSTION ENGINE

[75] Inventor: Makoto Ueno, Shizuoka, Japan

[73] Assignee: Toyota Jidosha Kabushiki Kaisha, Toyota, Japan

[21] Appl. No.: 500,991

[22] Filed: Jun. 3, 1983

[30] Foreign Application Priority Data

Jun. 29, 1982 [JP] Japan ..... 57-110749

[51] Int. Cl.[3] ..... F02D 13/06

[52] U.S. Cl. ..... 123/198 F; 123/90.16; 123/90.27; 123/90.32

[58] Field of Search ..... 123/198 F, 90.15, 90.16, 123/90.27, 90.28, 90.32

[56] References Cited

U.S. PATENT DOCUMENTS

| | | | |
|---|---|---|---|
| 4,221,200 | 9/1980 | Soeters | 123/198 F |
| 4,221,201 | 9/1980 | Soeters | 123/198 F |
| 4,227,494 | 10/1980 | Vitulugt | 123/90.16 |
| 4,245,596 | 1/1981 | Bruder et al. | 123/90.15 |
| 4,249,488 | 2/1981 | Siegla | 123/198 F |
| 4,256,070 | 3/1981 | Mueller | 123/198 F |
| 4,284,042 | 8/1981 | Springer | 123/90.16 |
| 4,337,738 | 7/1982 | Bubniak et al. | 123/198 F |
| 4,380,219 | 4/1983 | Walsh | 123/198 F |
| 4,386,590 | 6/1983 | Bates | 123/198 F |
| 4,387,680 | 6/1983 | Tsunetomi et al. | 123/198 F |

*Primary Examiner*—Ira S. Lazarus

*Attorney, Agent, or Firm*—Kenyon & Kenyon

[57] ABSTRACT

A valve stopping device of internal combustion engine comprising, an intake valve and an exhaust valve each provided with a valve stopping mechanism. The valve stopping mechanisms are connected with each other by a link mechanism so as to rotate synchronously. The turning angle of the valve stopping mechanism attached to the intake valve is larger than that of the exhaust valve. The intake valve operation therefore precedes the exhaust valve operation when the valves shut down and enter a closed state. The exhaust valve operation precedes the intake valve operation when the valves begin operation. Thus, burnt gas in cylinders is prevented from being blown back to the intake side during a valve shutdown control process.

6 Claims, 7 Drawing Figures

VALVE STOPPING DEVICE OF INTERNAL COMBUSTION ENGINE

BACKGROUND OF THE INVENTION

1. Field of the Invention

The present invention relates to a multicylinder internal combustion engine in which the fuel supply to some cylinders is cut off, in accordance with the engine load so as to achieve partial cylinder operation, more particularly, to a device which enables any of the intake valves and exhaust valves of the cylinders to be idled during partial cylinder operated.

2. Description of the Prior Art

Under a light engine load, it is possible to improve the engine thermal efficiency by maintaining either the intake or exhaust valve of some of the cylinders or, in some cases, both the intake and exhaust valves, in a fully closed state so as to eliminate the pumping work of the idle cylinders. Maintaining the valves of the idle cylinders in a fully closed state prevents air from flowing from the idle cylinders to the exhaust system, thus also prevents cooling of the catalyst device located in the exhaust system and prevents decreased exhaust gas cleaning efficiency of the catalyst device.

Various proposals have been made for techniques to idle intake and exhaust valves for such reduced cylinder operation, but these have all had defects.

The present inventor previously proposed in Japanese Utility Model Application No. 56-57839 an improved valve stopping device of an internal combustion engine. In the previous proposal, valve stopping mechanisms were mounted for each pair of intake and exhaust valves. The valve stopping mechanisms were connected to each other with crank arms and a link mechanism for synchronized rotation.

The valve stopping device proposed by the present inventor comprised, rocker arms rocking along with the rotation of cams; an intake valve and exhaust valve biased in the closed direction by valve springs; rotors rotatably attached to valve shafts of the valves and engaging and disengaging with the ends of the rocker arms; a rotor connecting means which connects the rotors with crank arms and a link mechanism for synchronized rotation of the rotors; and a rotating means for the rotors. The intake valve and exhaust valve operated when the ends of the rocker arms engage with the rotors. The valves shut down operation and entered a closed state when the rocker arms and rotors disengaged. In this previous device, each rotor was provided with a pair of small projections at diametrically opposed sides thereof. The working ends of the rocker arms were branched so as to form two claws. The space between the two claws was slightly larger than the diameter of the cylindrical part of the rotors. The distance between the two claws corresponded to the distance between the two small projections of the rotor. When the small projections aligned with the claws, the rotor rose and fell following the cam rotation so that the valve operated to open and shut (hereinafter, simply "operated"). When the rotor rotated 90° from that position, the claws at the end of the rocker arm straddled the cylindrical part of the rotor. Consequently, even if the rocker arm rocked, the rotor did not move. Thus, the valve shut down operation and enterned a closed state.

In the above stopping control device, however, when the engine speed was high, there was sometimes not enough time for the rotor to rotate 90° between the compression stroke and expansion stroke. At such times, the rotor rotated only little by little until the claws would come off from the upper face of the small projections. Thus, the intake valve and the exhaust valve would remain in the operation shutdown state.

Likewise, when trying conversely to operate the intake valve and exhaust valve from the operation shutdown state during high engine speed, the claws would engage the small projections first, so the rotor would sometimes only rotate a little before it rotated to the predetermined position. At this time, the play in the link mechanism and/or the manufacturing tolerances of the rotor and the claws would sometimes cause either the intake valve or the exhaust valve to first become closed or to first begin operating.

If either the intake valve or exhaust valve changed in operation state before the other, when operating intake and exhaust valves were shifted to the operation shutdown state, the exhaust valve sometimes stopped or become closed first. Conversely, when the intake and exhaust valves in the operation shutdown state were shifted to the operation state, the intake valve sometimes began to operate first. In such cases, the air-fuel mixture, intake air, or burnt gas in the cylinders was blown back into the intake pipe, thereby impeding the driveability of the engine.

SUMMARY OF THE INVENTION

The present invention is proposed to solve the above-mentioned problem in a valve stopping device of an internal combustion engine.

The object of the present invention is to provide a valve stopping device of an internal combustion engine in which each pair of intake and exhaust valves is provided with a valve stopping device and in which, when the valve stopping devices are operated synchronously, the intake valves stop first when the intake and exhaust valves are shut down and closed and, conversely, the exhaust valves are started first when the intake and exhaust valves are started for operation. Through this, gas in the cylinders is prevented from returning to the intake side during the valve stopping control process. Therefore, the reliability of engines with valve stopping devices is improved.

According to the present invention, there is provided a valve stopping device of an internal combustion engine comprising: rocker arms rocking along with the rotation of cams; an intake valve and exhaust valve biased in the closed direction by valve springs; rotors rotatably attached to valve shafts of the valves and engaging and disengaging with the ends of the rocker arms; a rotor connecting means which connects the rotors with crank arms and a link mechanism for synchronized rotation of the rotors; and a rotating means for the rotors. The intake valve and exhaust valve operate when ends of the rocker arms engage with the rotors. The valves shut down operation and enter a closed state when the rocker arms and rotors disengage.

In the above construction, the valve stopping device is similar to the previous device proposed by the present inventor. The current valve stopping device, however, is characterized in that the turning angle of the rotor on the intake valve shaft is larger than that of the rotor on the exhaust valve shaft.

Due to this new feature, in the valve stopping device of the internal combustion engine in which the intake valve and exhaust valve are controlled to operate synchronously, when the operating valves are shifted to the operation shutdown state, the intake valve closes before the exhaust valve. Conversely, when the valves in the operation shutdown state are shifted to the operation state, the exhaust valve opens before the intake valve. Thus, gas in the cylinders can be prevented from being blown back to the intake side during that control process. Therefore, the reliability and driveability of engines with valve stopping devices are improved.

DESCRIPTION OF THE PREFERRED EMBODIMENTS

A known valve stopping device of an internal combustion engine will first be described so as to clarify the difference between the preferred embodiments of the present invention and the conventional technique.

Figure 1:
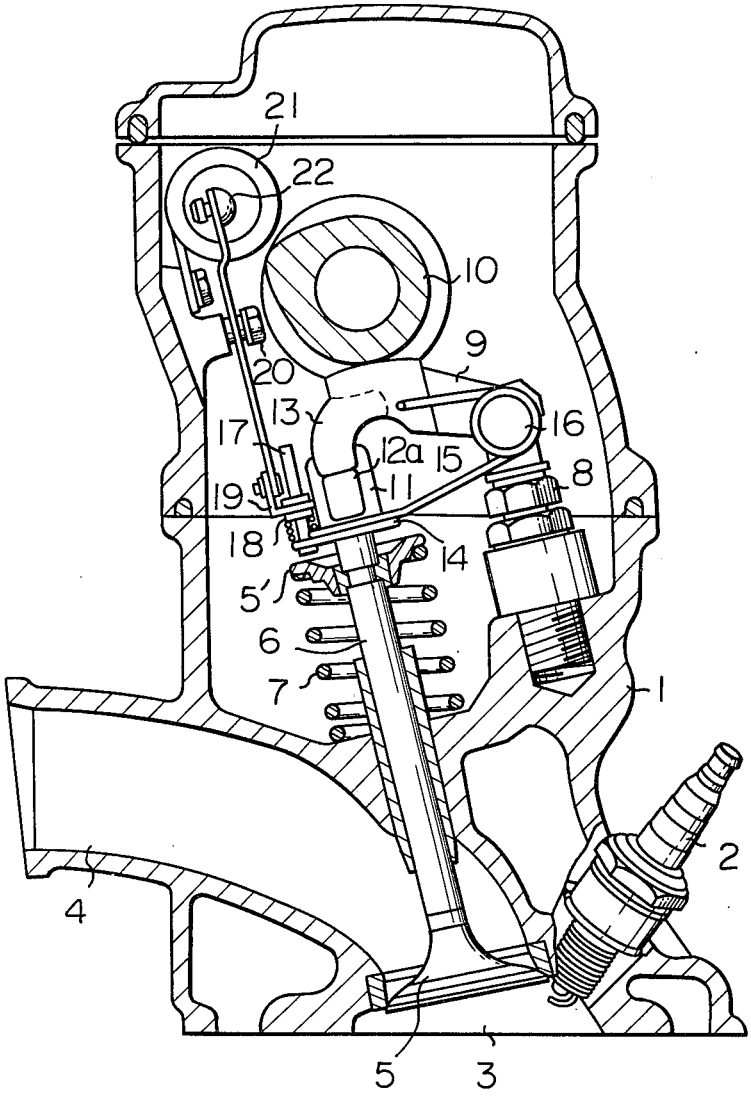
Fig. 1 PRIOR ART
FIG. 1 is a vertical section of a known valve stopping device of an internal combustion engine.
Figure 2:
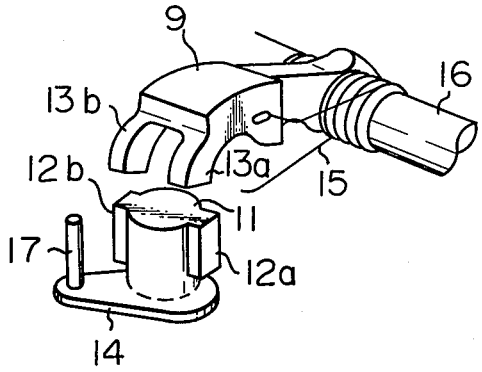
Fig. 2 PRIOR ART
FIG. 2 is a perspective view of a principal part of the device shown in FIG. 1.
Figure 3:
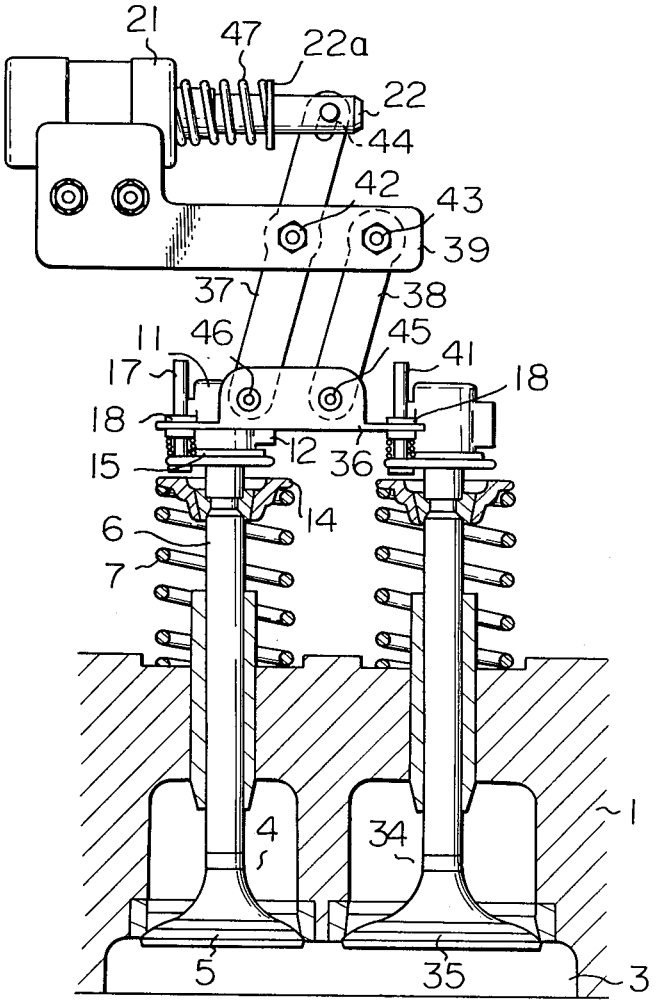
Fig. 3 PRIOR ART
FIG. 3 is a vertical section of an example in which the valve stopping device shown in FIG. 1 is attached to an intake valve and exhaust valve and in which the valves are operated synchronously.

FIGS. 1 to 3 show the valve stopping device of Japanese Utility Model Application No. 56-57839.

In FIG. 1, a cylinder head 1 has a spark plug 2, a combustion chamber 3 and an exhaust port 4. The exhaust port 4 has an exhaust valve 5. The exhaust valve 5 is urged to shut the exhaust port 4 by a valve spring 7, located between the upper face of the cylinder head 1 and a valve retainer 5', and is operated by a rocker arm 9. The rocker arm 9 rocks around a pivot screwed on the cylinder head 1 by a screw nut 8 along with the rotation of a cam 10, so that the end of the rocker arm 9 rises and falls. A valve shaft 6 of the exhaust valve 5 extends upward more than a normal valve shaft. A rotor 11 is rotatably attached on the extending part of the valve shaft 6 with a slight clearance.

As shown in FIG. 2, the rotor 11 has a pair of small projections 12*a* and 12*b* at diametrically opposed positions at the sides thereof. The working end of the rocker arm 9 is branched into two claws 13*a* and 13*b*.

The space between the claws 13*a* and 13*b* is slightly larger than the diameter of the cylindrical part of the rotor 11. Thus, when the rotor 11 rotates 90° from the position in FIG. 2, the claws 13*a* and 13*b* of the rocker arm 9 straddle the cylindrical part of the rotor 11. At the same time, the distance between the claws 13*a* and 13*b* corresponds to the distance between the small projections 12*a* and 12*b*. Thus, when the rotor 11 lies in the position in FIG. 2, the claws 13*a* and 13*b* contact the upper faces of the small projections 12*a* and 12*b*.

A coil type follower spring 15 is wound around a cylindrical supporting shaft 16 adjacent to the supporting point of the rocker arm 9. One end of the spring 15 acts on the upper face of a flange 14 formed on the lower part of the rotor 11 so that the rotor 11 is continuously pressed to the valve shaft 6. The other end of the spring 15 is fixed to the rocker arm 9. The reaction force working on the rotor 11 acts to press the rocker arm 9 to the cam 10.

A pin 17 is mounted on the end of the flange 14 of the rotor 11 in parallel with the valve shaft 6. One end of a lever 19 is slidably connected with the pin 17 along its axis via a sleeve 18. The lever 19 is suitably flexible. The intermediate part of the lever 19 is supported by a pin 20. The lever 19 can rock around the pin 20. The other end of the lever 19 is connected with a plunger 22 of a solenoid 21.

When the claws 13*a* and 13*b* of the rocker arm 9 contact the upper faces of the small projections 12*a* and 12*b* of the rotor 11, as shown in FIG. 2, the exhaust valve 5 is operated in accordance with the rocking motion of the rocker arm 9 along with the rotation of the cam 10. When the plunger 22 moves in the direction outward from the sheet in FIG. 1 along with supply of power to the solenoid 21, the lever 19 rocks around the pin 20, rotation force is given to the pin 17 connected with the end of the lever 19, and the rotor 11 rotates around the valve shaft 6. Thus, the small projections 12*a* and 12*b* of the rotor 11 change in position and move out of contact with the claws 13*a* and 13*b*. Because of this, even if the rocker arm 9 rocks along with the rotation of the cam 10, the acting force of the rocker arm 9 is not transmitted to the rotor 11 and the exhaust valve 5 does not operate.

As shown in FIG. 3, such a valve stopping device is attached to an intake valve 35 and exhaust valve 5 located on an intake port 34 and exhaust port 4 communicated with an opening part of the combustion chamber 3. The valve stopping devices are connected with each other so as to be controlled synchronously. Namely, sleeves 18, 18 are mounted on both ends of a connecting link 36. These sleeves are slidably connected with a pin 41 on the intake side and a pin 17 on the exhaust side, respectively. These pins 17 and 41 are connected with each other.

A driving lever 37 and a driven lever 38 having a resilient property are rotatably connected with the connecting link 36 with pins. The driving lever 37 is supported on a hanger 39 with a pin 42 at the intermediate part thereof, has a long hole 44 in the upper end, and is connected with the plunger 22 of the solenoid 21 via the long hole 44. The driven lever 38 is supported on the hanger 39 with a pin 43. The distance between the pin 43 and a pin 45 of the driven lever 38 corresponds to the distance between a pin 46 of the driving lever 37 and the pin 42. Thus, the connecting link 36, the levers 37 and 38, and the hanger 39 construct a parallel crank mechanism.

A return spring 47 is located between the solenoid 21 and a plate 22*a* mounted on the plunger 22. The spring 47 urges the plunger 22 to move to the projecting side when the solenoid 21 is deenergized. When the solenoid 21 is energized by a controller (not shown), the plunger 22 is drawn in against the return spring 47. Along with the movement of the plunger 22, the driving lever 37 rocks around the pin 42 supporting the intermediate part of the lever 37. The link 36 is thus shifted in the opposite direction with respect to the moving direction of the plunger 22 as well as the pin 46. Since the driving lever 37 and driven lever 38 construct a parallel link mechanism, the attitude of the connecting link 36 does not change during shifting, the connecting link 36 rotates the rotor 11 at the same time, and, thus, the intake valve 35 and the exhaust valve 5 are controlled simultaneously.

Moreover, the turning force of the rotor 11 created in the solenoid 21 is not strong enough to rotate the rotor 11 while the intake valve 35 and the exhaust valve 5 operate due to the rotation of the cam 10. The turning force can rotate the rotor 11 only while the base circle of the cam 10 contacts the rocker arm 9, that is, between the compression stroke and next expansion stroke of the engine. Thus, the intake valve 35 and the exhaust valve 5 remain in the closed state.

The preferred embodiments of the present invention will now be described, with reference to the drawings.

Figure 4:
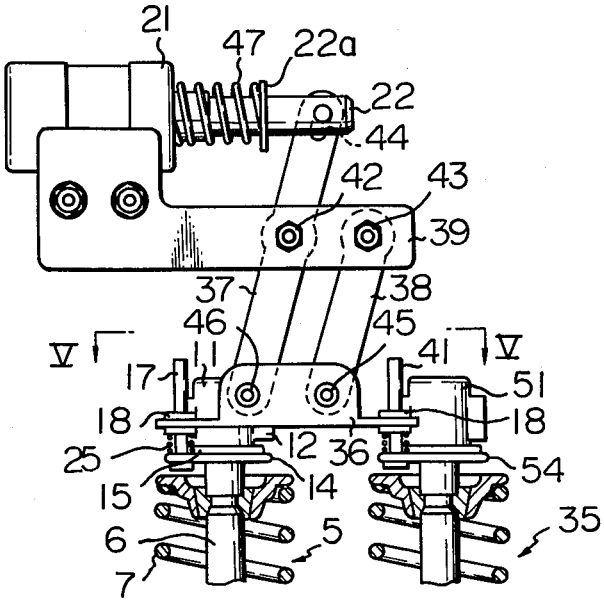
FIG. 4 is a vertical section of a first embodiment of the present invention.
Figure 5:
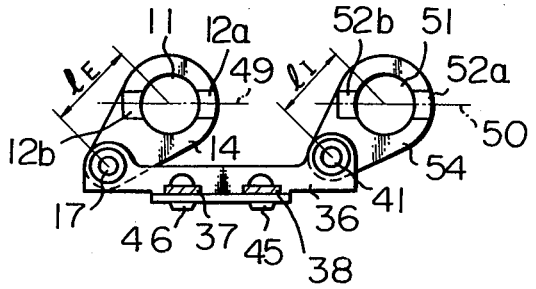
FIG. 5 is a plan view along line V—V of FIG. 4 looking in the direction of the arrows.

FIGS. 4 and 5 show a first embodiment of the present invention. Parts the same as in the device of FIGS. 1 to 3 are represented by the same numerals. A description of these corresponding parts are omitted.

A rotor 11 and a rotor 51 are attached to the exhaust valve shaft and the intake valve shaft, respectively, and are provided with a flange 14 and a flange 54 on their lower ends, respectively.

A pin 17 and a pin 41 are mounted on the flanges 14 and 54, respectively. These pins 17 and 41 are connected with each other by the link 36. The driving force created in the solenoid 21 is transmitted to the rotors 11 and 51 via the resilient driving lever 37 and a similar driven lever 38.

The above-mentioned constructure of the valve stopping device is the same as that of the device shown in FIGS. 1 or 3.

In this embodiment, however, the pin 41 to be mounted on the rotor 51 of the intake valve side is fixed at a distance $l_I$, from the rotary center of the rotor 51. The pin 17 to be mounted on the rotor 11 of the exhaust valve side is fixed at a distance $l_E$, from the rotary center of the rotor 11. The length of each crank arm is set so that $l_E$ is greater than $l_I$ (i.e., $l_E > l_I$).

Moreover, the rotor 51 of the intake valve side is also provided with small projections **52*a* and 52*b* as well as the rotor 11 of the exhaust valve side. These small projections contact two claws (not shown) on the end of the rocker arm (not shown). In the operation state of the intake and exhaust valves, the rotors 11 and 51 are located so that either center lines 49 and 50 of the respective small projections 12*a*, 12*b* and 52*a*, 52*b* intersect the longitudinal center line of the rocker arm 9 precisely at a right angle, that is, the contact line between two claws 13*a*, 13*b* of the rocker arm 9 and the small projections 12*a*, 12*b* and 52*a*, 52*b* is parallel to the center lines 49 and 50**.

In this valve stopping device, when the solenoid 21 is energized, the plunger 22 is drawn toward the solenoid 21 and the connecting link 36 is shifted via the driving lever 37. At this time, the greater length of the crank arm of the rotor 11 over that of the rotor 51, i.e., $l_E > l_I$, creates a phase difference in the turning angle between the rotor 11 and the rotor 51 during their rotation. The turning angle of the rotor 51 of the intake valve 35 therefore becomes larger than that of the rotor 11 of the exhaust valve 5. Thus, the intake valve 35 shuts down operation and enters the closed state earlier than the exhaust valve 5. The driving lever 37 then shifts the connecting link 36, whereby the exhaust valve 5 shuts down and enters the closed state.

As mentioned earlier, in the device shown in FIGS. 1 to 3, when the engine speed was low, the exhaust valve 5 could complete its shutdown operation in one compression stroke and expansion stroke cycle, but when the engine speed was high, it took from several to 20 cycles for completion. However, according to this embodiment, the phase difference in the turning angle between the rotor 11 and the rotor 51 enables reliable shutdown of the intake valve 35 before the exhaust valve 5. Thus, gas in the cylinders is prevented from being blown back to the intake passage. Conversely, when the intake and exhaust valves 35 and 5 are changed from the closed operation shutdown state to the operation state, since the rotation of the rotor 51 of the intake valve 35 is delayed over that of the rotor 11 of the exhaust valve 5, the small projections **12*a* and 12*b* contact the claws 13*a* and 13*b* of the rocker arm 9 first. The exhaust valve 5 is thus given a driving force to begin operation earlier than the intake valve 35**. Thus, gas in the cylinders is prevented from being blown back to the intake passage.

Figure 6:
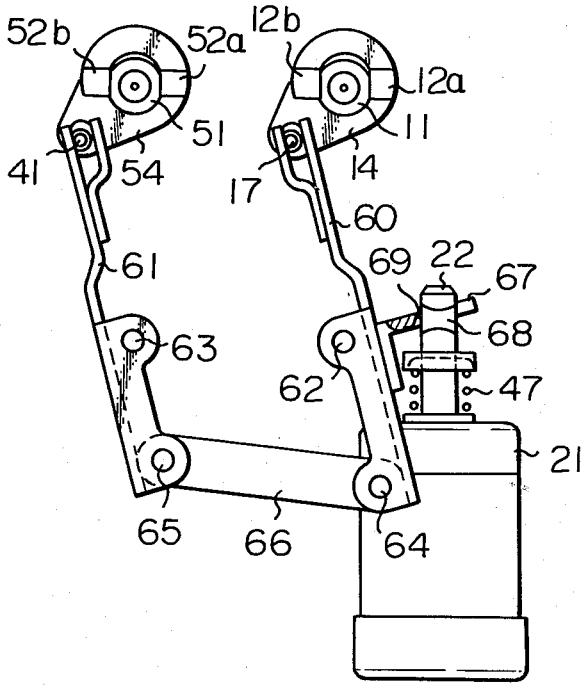
FIGS. 6 and 7 are plan views of a second embodiment of the present invention, FIG. 6 showing the operation state of the intake valve and the exhaust valve and FIG. 7 showing the operation shutdown state of the intake valve and the exhaust valve.
Figure 7:
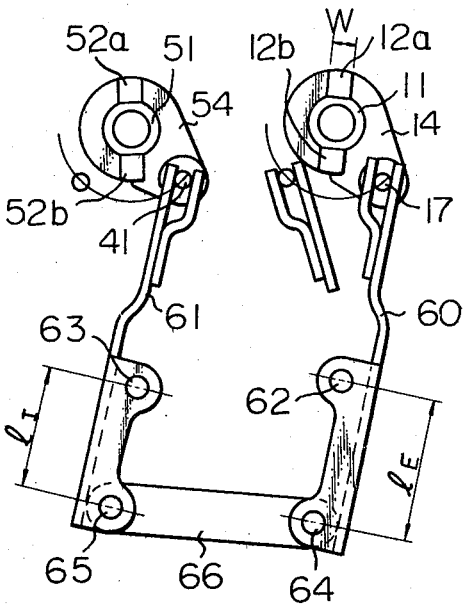

FIGS. 6 and 7 show a second embodiment of the present invention. These figures show only the relative position between each rotor and the connecting mechanisms when the intake and exhaust valves are operating and when they are shutting down. The principal parts of the valve system are omitted from brevity.

The difference between this embodiment and the first embodiment is that two levers 60 and 61 and a connecting link 66 connecting these levers are used as the link mechanism connecting the rotors 11 and 51 in place of the single connecting link 36 in the first embodiment. Also, the distances between the pivoting points of the levers 60 and 61 and rocking points of these levers are different instead of the lengths of the crank arms being different. That is, the levers 60 and 61 have pivoting points 62 and 63 as rotary centers of these levers. One of the ends of the levers 60 and 61 are connected with each other by a link 66. Connecting points 64 and 65 are made the rocking points. The other ends of the levers 60 and 61 are forked. These forked parts each hold between them pins 17 and 41 mounted on the rotors 11 and 51 respectively.

The plunger 22 of the solenoid 21 is provided with a groove 68 matching a groove 69 of a forked arm 67 mounted on the intermediate part of the lever 60. The plunger 22 is connected with the arm 67 via these grooves 68 and 69. The driving force created in the solenoid 21 is transmitted to the lever 60 via the plunger 22 and the arm 67 and is further transmitted to the lever 61 via the link 66.

The distance $l_I$ between the pivoting point 63 and the rocking point 65 in the lever 61 of the intake valve side and the distance $l_E$ between the pivoting point 62 and the rocking point 64 in the lever 60 of the exhaust valve side are set so that the distance $l_I$ is smaller than the distance $l_E$ (i.e., $l_E > l_I$).

When the solenoid 21 is energized, the rotation of the levers 60 and 61 causes the rotors 11 and 51 to be shifted from the intake- and exhaust-valves operation state of FIG. 6 to the valve operation shutdown state of FIG. 7. At this time, the relationship of the levers $l_E > l_I$ creates a phase difference in turning angle between the rotors 11 and 51. Thus, the same effect as that of the first embodiment is obtained.

Moreover, as shown in FIG. 7, due to the phase difference in turning angle, the center line of the small projections **12*a* and 12*b* of the rotor 11 may be located so as not to intersect the longitudinal center line of the rocker arm 9 at a right angle. Therefore, even in this case, the claws 13***a* and 13*b* of the rocker arm 9 must be prevented from contacting the small projections 12*a* and 12*b*. For that reason, the width W of the small projections 12*a* and 12*b* must be sufficiently smaller than the space between the claws 13*a* and 13*b* (the diameter of the head of the rotor), and it is necessary to suitably select the ratio between $l_I$ and $l_E$ ($l_I$:$l_E$).

I claim:

1. A valve stopping device of an internal combustion engine comprising:

rocker arms rocking along with rotation of cams;

an intake valve and an exhaust valve biased in a closed direction by valve springs;

rotors rotatably attached on valve shafts of said valves and engaging and disengaging with ends of said rocker arms;

a rotor connecting means which connects said rotors with crank arms and a link mechanism for synchronized rotation of the rotors; and a rotating means for said rotors;

the valves operating to open and shut when the ends of said rocker arms engage with said rotors, and shutting down to a closed state when the rocker arms and the rotors disengage;

characterized in that turning angles of the rotors are set so that the turning angle of the rotor attached to the intake valve shaft is larger than that of the rotor attached to the exhaust valve shaft.

2. A valve stopping device of an internal combustion engine according to claim 1, wherein said rotors have two small projections at diametrically opposed positions on their sides; and said rocker arms have two claws at ends thereof which hold heads of said rotors therebetween and which contact only upper surfaces of the small projections.

3. A valve stopping device of an internal combustion engine according to claim 1, wherein said rotors are provided with flanges at their lower ends;

pins are mounted on the flanges parallel to the valve shaft; and the pins are connected with each other by a link mechanism.

4. A valve stopping device of internal combustion engine according to claim 3, wherein a distance between a rotary center of the rotor attached to the intake valve shaft and the pin of the intake valve side is shorter than a distance between a rotary center of the rotor attached to the exhaust valve shaft and the pin of the exhaust valve side.

5. A valve stopping device of an internal combustion engine according to claim 3 wherein said link mechanism comprises;

two levers pivotted on the engine body at each intermediate part thereof and connected with each other by a link at each end thereof so that the connected points are made rocking points;

the other ends of the levers are provided with forks between which the pins mounted on the rotor are inserted; and the distances between each pivotting point and rocking point are set so that the distance between the pivotting point of the lever connected with the intake valve side and the rocking point of the same side is smaller than the distance between the pivotting point of the lever connected with the exhaust valve side and the rocking point of the same side.

6. A valve stopping device of an internal combustion engine according to claim 3, wherein one of said pins is slidably connected with an end of a rocking lever and the other end of said rocking lever is connected with a plunger of a solenoid.

* * * * *

UNITED STATES PATENT AND TRADEMARK OFFICE

CERTIFICATE OF CORRECTION

PATENT NO. : 4,463,717

DATED : August 7, 1984

INVENTOR(S) : Ueno

It is certified that error appears in the above-identified patent and that said Letters Patent is hereby corrected as shown below:

Col. 1, line 13, change "operated" to --operation--.

Col. 8, line 19, change "pivotted" to --pivoted--.

Col. 8, lines 26, 28, 30-31, change "pivotting" to --pivoting--.

Signed and Sealed this

*Fifth* Day of *February 1985*

[SEAL]

*Attest:*

DONALD J. QUIGG

*Attesting Officer* *Acting Commissioner of Patents and Trademarks*